US005138395A

United States Patent [19]

Lindblad et al.

[11] Patent Number: 5,138,395

[45] Date of Patent: Aug. 11, 1992

[54] INTERNALLY LUBRICATED CLEANING BLADE

[75] Inventors: Nero R. Lindblad, Ontario; Richard L. Carlston, Rochester; Herbert C. Relyea, Webster, all of N.Y.

[73] Assignee: Xerox Corporation, Stamford, Conn.

[21] Appl. No.: 628,554

[22] Filed: Dec. 17, 1990

[51] Int. Cl.[5] ..... G03G 21/00

[52] U.S. Cl. ..... 355/299; 15/256.5; 355/296

[58] Field of Search ..... 355/299, 296; 15/256.5, 15/256.51; 430/125; 524/261, 404, 406; 525/185, 190

[56] References Cited

U.S. PATENT DOCUMENTS

| | | | |
|---|---|---|---|
| 3,936,183 | 2/1976 | Sadamatsu | 355/15 |
| 4,051,096 | 9/1977 | Koseki et al. | 524/404 X |
| 4,970,560 | 12/1988 | Lindblad et al. | 355/299 |
| 4,978,999 | 12/1990 | Frankel et al. | 355/299 |
| 5,034,430 | 7/1991 | Bäbler | 524/406 X |

FOREIGN PATENT DOCUMENTS

| | | |
|---|---|---|
| 0329144 | 8/1989 | European Pat. Off. . |
| 0064612 | 6/1981 | Japan . |
| 0120349 | 9/1981 | Japan . |
| 0203480 | 11/1983 | Japan . |
| 61-144684 | 7/1986 | Japan . |

OTHER PUBLICATIONS

Xerox Disclosure Journal, vol. 1; No. 4, Apr. 1976, p.79, "Impregnated Poromeric Material Cleaning Blade" by Paul Spencer and David Fisher.

*Primary Examiner*—A. T. Grimley
*Assistant Examiner*—Nestor R. Ramirez

[57] ABSTRACT

A cleaning blade which is made from a thermoplastic material having a compounded additive for lubrication. The cleaning blade is used in an electrophotographic printing machine to remove residual particles from a photoconductive surface.

13 Claims, 2 Drawing Sheets

INTERNALLY LUBRICATED CLEANING BLADE

BACKGROUND OF THE INVENTION

The invention relates generally to an electrophotographic printing, and more particularly, a cleaning blade used therein to remove particles adhering to the photoconductive member.

In the process of electrophotographic printing, a photoconductive surface is charged to a substantially uniform potential. The photoconductive surface is imagewise exposed to record an electrostatic latent image corresponding to the informational areas of an original document being reproduced. The records an electrostatic latent image on the photoconductive surface corresponding to the informational areas contained within the original document. Thereafter, a developer material is transported into contact with the electrostatic latent image. Toner particles are attracted from the carrier granules of the developer material onto the latent image. The resultant toner powder image is then transferred from the photoconductive surface to a sheet of support material and permanently affixed thereto.

This process is well known and useful for light lens copying from an original and printing applications from electronically generated or stored originals, and in ionography.

In a reproduction process of the type as described above, it is inevitable that some residual toner will remain on the photoconductive surface after the toner image has been transferred to the sheet of support material (e.g. paper). It has been found that with such a process that the forces holding some of the toner particles to the imaging surface are stronger than the transfer forces and, therefore, some of the particles remain on the surface after transfer of the toner image. In addition to the residual toner, other particles, such as paper debris (i.e. Kaolin, fibers, clay), additives and plastic, are left behind on the surface after image transfer. (Hereinafter, the term "residual particles" encompasses residual toner and other residual particles remaining after image transfer.) The residual particles adhere firmly to the surface and must be removed prior to the next printing cycle to avoid its interfering with recording a new latent image thereon.

Various methods and apparatus may be used for removing residual particles from the photoconductive imaging surface. Hereinbefore, a cleaning brush, a cleaning web, and a cleaning blade have been used. Both cleaning brushes and cleaning webs operate by wiping the surface so as to affect transfer of the residual particles from the imaging surface thereon. After prolonged usage, however, both of these types of cleaning devices become contaminated with toner and must be replaced. This requires discarding the dirty cleaning devices. In high-speed machines this practice has proven not only to be wasteful but also expensive.

The shortcomings of the brush and web made way for another now prevalent form of cleaning known and disclosed in the art—blade cleaning. Blade cleaning involves a blade, normally made of a rubberlike material (e.g. polyurethane) which is dragged or wiped across the surface to remove the residual particles from the surface. Blade cleaning is a highly desirable method, compared to other methods, for removing residual particles due to its simple, inexpensive structure. However, there are certain deficiencies in blade cleaning, which are primarily a result of the frictional sealing contact that must occur between the blade and the surface.

Dynamic friction is the force that resists relative motion between two bodies that come into contact with each other while having separate motion. This friction between the blade edge and the surface causes wearing away of the blade edge, and damages the blade's contact with the surface. For purposes of this application, volume wear (W) is proportional to the load (F) multiplied by the distance (D) traveled. Thus, $W \propto FD \propto FVT$, or introducing a factor of proportionality K, $W=KFVT$ where K is the wear factor, V is the velocity and T is the elaspsed time. Hence, wear increases with larger values of K. Various blade lubricating materials or toner lubricant additives have been proposed to reduce friction which would thereby reduce wear. However, lubricants tend to change the operational characteristics of the printing machine undesirably. For example, a polyurethane blade with a good lubricant in the toner can ideally achieve a frictional coefficient of about 0.5, however, this rarely occurs because of the delicate balance involved in achieving the proper weight percent of lubricant in the toner. (Normal frictional coefficient values for cleaning blades that remove toner off the imaging surface range from a low of about 0.5 to a high of about 1.5). It is an object of the present invention, to consistently achieve a coefficient of friction of 0.5 or less, and thus reduce the amount of volume wear on the blade edge used for cleaning.

In addition to the problem of volume wear, blades are also subject to unpredictable failures. In normal operational configuration, with a coefficient of dynamic friction in the range of about 0.5 to about 1.5, a blade cleaning edge or tip in sealing contact with the surface is tucked slightly. The blade is not in intimate contact with the surface, but slides on toner particles and lubricant to maintain the sealing contact required for cleaning. In this configuration, the blade may flatten particles that pass under the blade and cause impaction of particles on the surface. This is called cometing because of the comet-like impressions created by the flattened particles. Also the carrier beads remaining on the surface subsequent to development may damage the blade. Another common failure is localized increases in friction between the blade and surface that cause the phenomenon of severe tucking, where the blade cleaning edge becomes tucked underneath the blade. When this occurs the cleaning blade material can fracture in the region where the severe tuck occurs and damage the blade permanently. Still another common failure occurs at start-up, when the frictional force between the blade and the surface is so high that it causes the blade to foldover on itself overstressing the blade. These types of failure require removal and replacement of the blade. Since most failures in blade cleaning systems are caused from nicking caused by tucking, it is an object of this invention, to eliminate this tucking problem, and thus, substantially improve the efficiency of blade cleaning systems.

The commonly used elastomer-type cleaning blade is a resilient material that allows stubborn residual particles to remain on the surface. This occurs because the resilient elastomeric material is unable to provide sufficient contact to create a tight seal between the cleaning blade and the surface when tuck occurs, therefore the resiliency of the elastomeric blade makes it easy for the blade to glide over the residual particles. It is an object of this invention to provide adequate rigidity to avoid the resiliency problem of the elastomer-type blade.

While it might appear that a rigid metal blade might solve the problems of rigidity and wear, in fact, the frictional contact required between the surface and blade quickly wears away the blade and any surface lubricants applied thereto. As the blade edge wears, it changes from a chiseling edge to a rounded or flattened surface which requires a high force to maintain the edge in sealing contact. While a beveled edge is useful in liquid toner applications, it is highly susceptible to damage and wear in dry toner applications. Accordingly, it is desirable to maintain the blade's square edge without wear. Additionally, wearing friction may generate toner fusing temperatures, causing toner to fuse to the blade, or the surface. Furthermore, filming on the surface can deteriorate image quality. Filming occurs either uniformly or as streaking, due to deficiencies in blade cleaning, requiring the use of a lubricant and a balancing abrasion element to prevent filming. It is an object of the present invention to provide continuous lubrication.

Various cleaning techniques have hereinbefore been used as illustrated by the following disclosures, which may be relevant to certain aspects of the present invention:

Xerox Disclosure Journal, Vol. 1; No. 4, April, 1976, page 79, "Impregnated Poromeric Material Cleaning Blade" by Paul Spencer, and Donald J. Fisher suggests the use of a porous material of non-woven fibers bound together with polyurethane which is then saturated with various materials including low friction or lubricant materials.

U.S. Pat. No. 3,936,183 to Sadamatsu describes a surface coating on the blade material.

EP-A-0 329 144 A2 discloses a silicone-modified prepolymer formed by the reaction of polyurethane prepolymer and silicone oil in a solvent.

U.S. Pat. No. 4,970,560 to Linblad discloses a metal blade that has lubricant infused into the pores of the coating only.

SUMMARY OF INVENTION

Briefly stated, and in accordance with the present invention, there is provided an apparatus for cleaning particles from a surface. The apparatus includes means for cleaning particles from the surface. The cleaning means is constructed by compounding a lubricating additive into a polymeric material. Means provide relative motion between the surface and the cleaning means such that the surface moves against the cleaning means producing a frictional force while removing the particles from the surface without damaging the surface.

Pursuant to the features of the invention, there is provided an electrophotographic printing machine having a movable surface upon which there are particles. The cleaning means is constructed from a material by compounding a lubricating additive into the polymeric material. Means provide relative motion between the surface and the cleaning means such that the surface moves against the cleaning means producing a frictional force while removing the particles from the surface without damaging the surface.

Pursuant to the features of the invention, there is provided a cleaning blade made from a rigid member and a lubricant additive that is internally combined by compounding with the rigid member to form a composite.

BRIEF DESCRIPTION OF THE DRAWINGS

Other objects and advantages of the present invention will become apparent upon reading the following detailed description and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
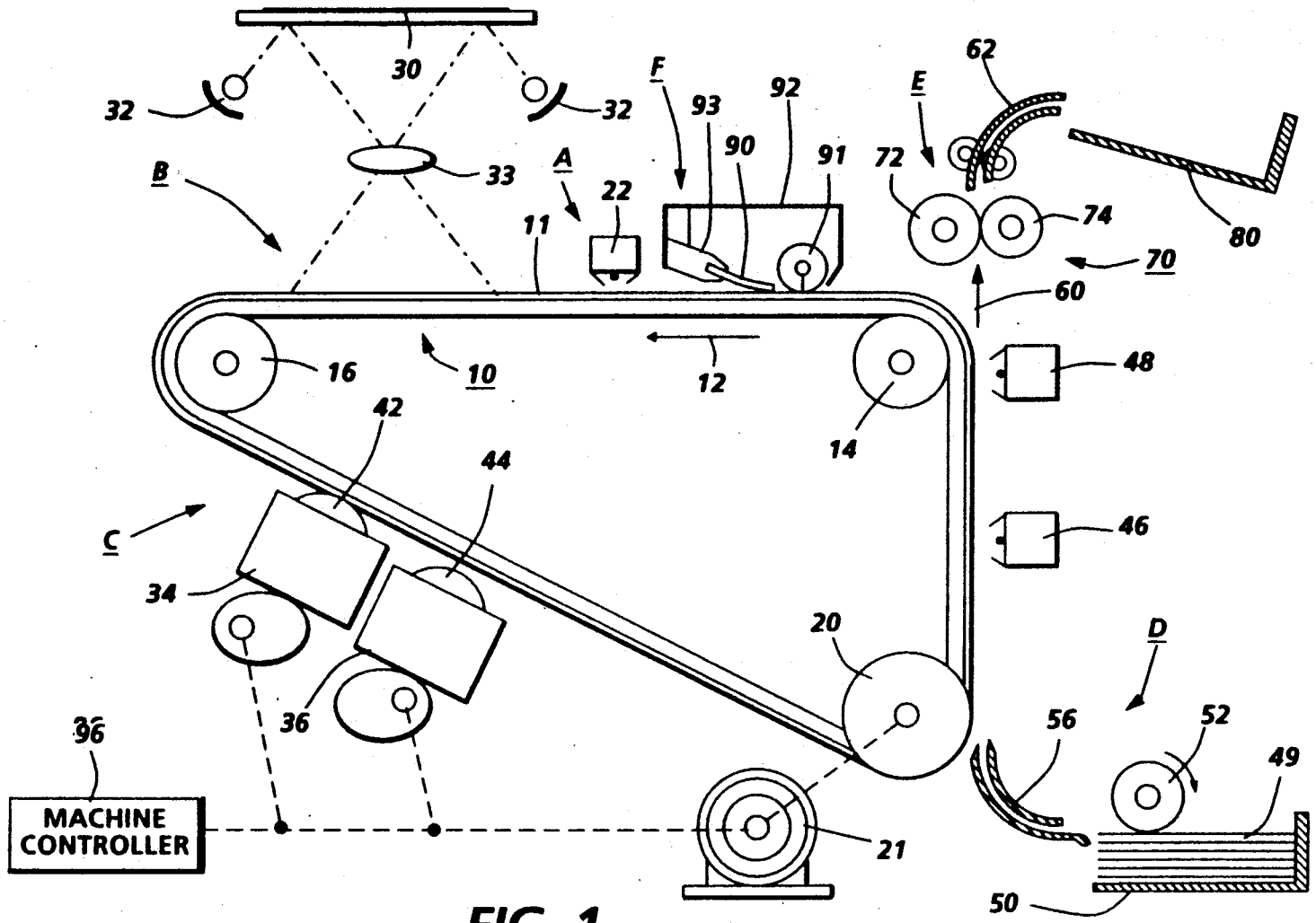
FIG. 1 is a schematic elevational view depicting an electrophotographic printing machine incorporating the features of the present invention therein.

For a general understanding of an electrophotographic printing machine in which the present invention may be incorporated, reference is made to FIG. 1 which depicts schematically the various components thereof. Hereinafter, like reference numerals will be employed throughout to designate identical elements. Although the cleaning apparatus of the present invention is particularly well adapted for use in an electrophotographic printing machine, it should become evident from the following discussion that it is equally well suited for use in a wide variety of devices and is not necessarily limited to the particular embodiments shown herein.

Referring now to the drawings, where the showings are for the purpose of describing a preferred embodiment of the invention and not for limiting same, the various processing stations employed in the reproduction machine illustrated in FIG. 1 will be described briefly hereinafter. It will no doubt be appreciated that the various processing elements also find advantageous use in electrophotographic printing applications from an electronically stored original, and with appropriate modifications, to an ion projection device which deposits ions in image configuration on a charge retentive surface.

A reproduction machine in which the present invention finds advantageous use utilizes a photoreceptor belt 10, having a photoconductive surface 11. Belt 10 moves in the direction of arrow 12 to advance successive portions of the belt sequentially through the various processing stations disposed about the path of movement thereof. Belt 10 is entrained about stripping roller 14, tension roller 16, and drive roller 20. Drive roller 20 is coupled to a motor 21 by suitable means such as a belt drive. Belt 10 is maintained in tension by a pair of springs (not shown) resiliently urging tension roller 16 against belt 10 with the desired spring force. Both stripping roller 14 and tension roller 16 are rotatably mounted. These rollers are idlers which rotate freely as belt 10 moves in the direction of arrow 12.

With continued reference to FIG. 1, initially a portion of belt 10 passes through charging station A. At charging station A, a corona device 22 charges photoreceptor belt 10 to a relatively high, substantially uniform potential, either positive or negative.

At exposure station B, an original document is positioned face down on a transparent platen 30 for illumination with flash lamps 32. Light rays reflected from the original document are reflected through a lens 33 and projected onto a charged portion of photoreceptor belt 10 to selectively dissipate the charge thereon. This records an electrostatic latent image on the belt which corresponds to the informational area contained within the original document. Alternatively, a laser may be provided to imagewise discharge the photoreceptor in accordance with stored electronic information.

Thereafter, belt 10 advances the electrostatic latent image to development station C. At development station C, one of at least two developer housings 34 and 36 is brought into contact with belt 10 for the purpose of developing the electrostatic latent image. Housings 34 and 36 may be moved into and out of developing position with corresponding cams 38 and 40, which are selectively driven by motor 21. Each developer housing 34 and 36 supports a developing system, such as magnetic brush rolls 42 and 44, which provides a rotating magnetic member to advance developer mix (i.e., carrier beads and toner) into contact with the electrostatic latent image. The electrostatic latent image attracts toner particles from the carrier beads, thereby forming toner powder images on photoreceptor belt 10. If two colors of developer material are not required, the second developer housing may be omitted.

Belt 10 then advances the developed latent image to transfer station D. At transfer station D, a sheet of support material such as paper copy sheets is advanced into contact with the developed latent images on belt 10. Corona generating device 46 charges the copy sheet to the proper potential so that it is tacked to photoreceptor belt 10 and the toner powder image is attracted from photoreceptor belt 10 to the sheet. After transfer, a corona generator 48 charges the copy sheet to an opposite polarity to detack the copy sheet for belt 10, whereupon the sheet is stripped from belt 10 at stripping roller 14.

Sheets of support material 49 are advanced to transfer station D from a supply tray 50. Sheets are fed from tray 50 with sheet feeder 52, and advanced to transfer station D along conveyor 56.

After transfer, the sheet continues to move in the direction of arrow 60 to fusing station E. Fusing station E includes a fuser assembly, indicated generally by the reference numeral 70, which permanently affixes the transferred toner powder images to the sheets. Preferably, fuser assembly 70 includes a heated fuser roller 72 adapted to be pressure engaged with a backup roller 74 with the toner powder images contacting fuser roller 72. In this manner, the toner powder image is permanently affixed to the sheet, and such sheets are directed via a shoot 62 to an output 80 or finisher.

Residual particles remaining on photoreceptor belt 10 after each copy is made, may be removed at cleaning station F with the combination of a cleaning blade 90 and an auger 91 for removal of the residual particles within a housing 92. Removed residual particles may be stored for disposal.

Machine controller 96 is preferably a known programmable controller or combination of controllers, which conventionally control all the machine steps and functions described. Controller 96 is responsive to a variety of sensing devices to enhance control of the machine, and also provides connection of diagnostic operations to a user interface (not shown) where required.

As thus described, a reproduction machine in accordance with the present invention may be any of several well known devices. Variations may be expected in specific electrophotographic processing, paper handling and control arrangements without affecting the present invention.

It is believed that the foregoing description is sufficient for purposes of the present application to illustrate the general operation of an electrophotographic printing machine which exemplifies one type of apparatus employing the present invention therein. The structure of the cleaning blade will be described hereinafter with reference to FIGS. 2 and 3.

Figure 2:
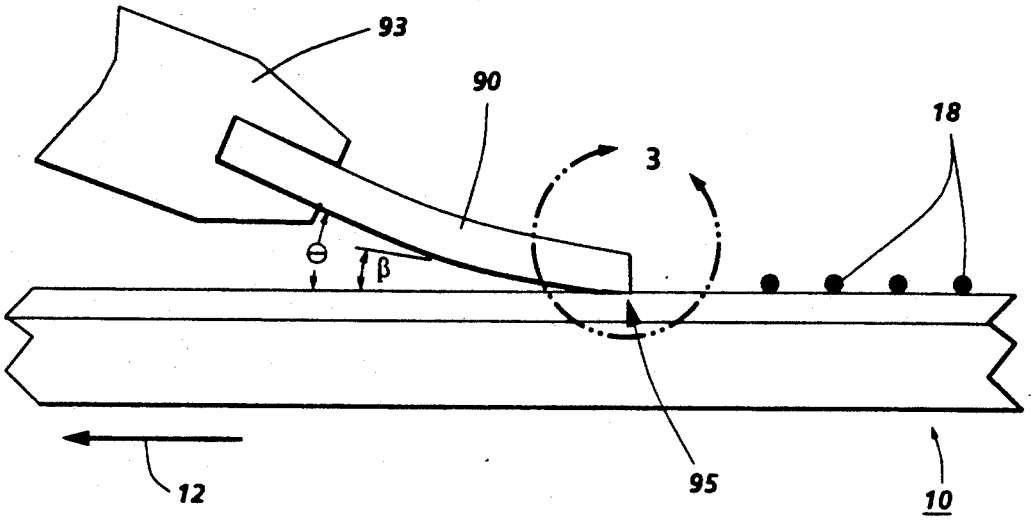
FIG. 2 is a schematic elevational view illustrating one configuration of the cleaning blade employed in the FIG. 1 electrophotographic printing machine.

Referring now to FIG. 2 which shows a cleaning blade 90 in a cleaning relationship with a photoconductive surface 11 of belt 10. A blade holder 93 is provided to support blade 90 in a sealing contact with surface 11. Cleaning blade edge 95 is located where blade 90 and imaging surface 11 meet to form a sealing contact. In the doctoring mode that is depicted in FIG. 2, the cleaning blade edge 95 acts as a scraper in removing the residual particles 18 from the imaging surface 11. The cleaning blade edge 95 is in frictional contact with the imaging surface 11 as the imaging surface 11 moves in the direction 12 indicated.

Cleaning blade 90 is made from a rigid thermoplastic member or similar material which avoids tucking at the cleaning edge 95. The rigidity of the blade can be determined by the thickness of the blade and the flex modulus. By way of an example, a thermoplastic blade made of polyacetal with a compounded additive of polytetraflouroethylene (PTFE) has a flex modulus of about $2\times10^5$ to $5\times10^5$ psi. The rigidity of the cleaning blade 90 in conjunction with the appropriate load prevents the cleaning blade 90 from riding on the toner in a cleaning relationship with photoreceptor belt 10.

The blade holder angle $\theta$ typically ranges from about 10° to about 25°. The working angle $\beta$ of the thermoplastic composite blade 90 ranges from about 5° to about 15°. Typically the free length of blade 90 extending from blade holder 93 is about 0.4 inches and the thickness of blade 90 ranges from 0.002 to 0.020 inches. The described blade arrangement is only exemplary, and other blade arrangements are possible.

Figure 3:
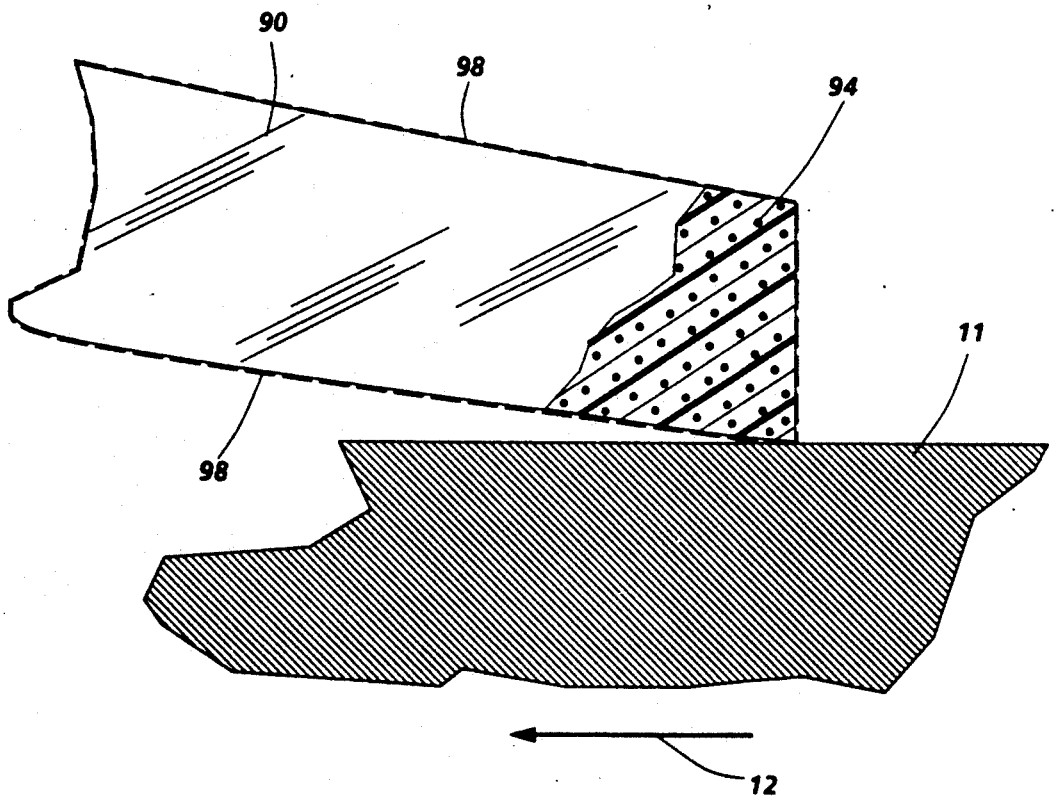
FIG. 3 is an enlarged partial sectional view of the area designated in FIG. 2 as 3.

Referring now to the specific subject matter of the present invention, FIG. 3 depicts a partial sectional view of the cleaning blade 90 composite material. In accordance with the invention, as shown in FIG. 3, a polymeric thermoplastic material (e.g. polyacetal such as Delrin®, polycarbonate, polyamide, and Ultra High Molecular Weight polyethylene) is melt mixed or heat mill mixed with a lubricating additive (e.g. PTFE, Kynar, silicone, graphite, Boron Nitride and molybdenum disulfide ($MoS_2$)) to create the composite material containing a compounded lubricant additive 94 to be used for a cleaning blade 90. The compounded additive 94 within the thermoplastic material creates microscopic-like lubricant domains 98 on the cleaning blade 90 surface. These domains 98 make the surface of the blade 90 feel slippery and creates a lubricating function between the surface 11 and the blade edge 95 shown in FIG. 2. As a result of the lubricant domains, the coefficient of friction is reduced and thus excessive wear of the blade is reduced. For example, the dynamic coefficient of friction of urethane and lubricated thermoplastics cleaning blade materials have been measured on a moving clean glass surface and a organic photoreceptor surface. The dynamic frictional coefficient is in the range from 4 to 7. On a moving clean glass surface the friction varies from 3 to 5 for these urethane cleaning blades. These values are high compared to values found in the xerographic copier. The friction is about 5 times greater without the toner and the lubricating additives. The dynamic frictional coefficient for Delrin ® on a moving glass and a photoreceptor surface is 0.17 and 0.12 respectively; a significant decrease in the dynamic coefficient of friction. With the PTFE lubricant compounded into the Delrin ® the friction drops 0.075 and 0.086 for clean glass and photoreceptor respectively. As the friction between the cleaning blade and the photoreceptor is reduced, the blade force required to make the blade clean toner is also reduced. Thus, the remarkable low values of friction impact not only the wear of the blade but also the wear of the photoreceptor surface.

With continued reference to FIG. 3, the amount of additive compounded into the thermoplastic material is determined on a weight percent basis. The weight percent (e.g. 10 to 20 weight percent) is considered sufficient when it provides an adequate lubricating function between the cleaning blade 90 and the imaging surface 11.

The compounded lubricant additive 94 (e.g. PTFE, Kynar, silicone, graphite, Boron Nitride and $MoS_2$) provides continuous lubrication of the cleaning blade 90 surface. As a part of the blade 90 material, the compounded additive 94 is constantly supplying lubricant to the blade edge 95 as a result of the frictional contact during relative motion between the cleaning blade edge 95 and the imaging surface 11. This frictional contact between the edge 95 and the surface 11 brings the lubricating domains 98 to the surface and creates a lubricating function as the cleaning blade edge 95 contacts the imaging surface 11 to remove the residual particles 18. In typical cleaning blade systems the lubricant must be coated on the outside surface of the cleaning blade and/or applied to the imaging surface. Once the lubricant coating on the blade or the lubricant added to the imaging surface runs out, the increase in frictional forces causes rapid wear of the blade which requires blade replacement. The present invention avoids this problem by having an internal lubricant additive. This lubricant is homogeneously dispersed throughout the blade, and is available at the surface of the blade for the life of the blade.

In recapitulation, it is evident that the cleaning blade of the present invention includes a thermoplastic material with a compounded lubricant additive (e.g. PTFE, Kynar, silicone, graphite, Boron Nitride and $MoS_2$) that lubricates the blade surface so that when there is contact between the blade and the surface to remove particles, frictional forces are reduced between the surface and the blade. The pressure of the cleaning blade against the imaging surface during relative motion between these surfaces maintains a lubrication between the blade and the surface because the additive is a part of the blade material and thus continually provides lubricant to the blade surface. The reduction in the dynamic friction between the surfaces increases the wear life of the blade and the photoreceptor. The rigidity of the cleaning blade edge also decreases the volume wear on the cleaning edge and decreases failure due to nicking and tucking associated with softer blades such as polyurethane.

It is, therefore, evident that there has been provided in accordance with the present invention, a blade of a composite material for removing particles from the photoconductive surface. The blade of the present invention fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed:

1. An apparatus for cleaning a surface having particles thereon, comprising:

means for cleaning particles from the surface, said cleaning means constructed of a material with a compounded lubricant additive;

means for providing relative motion between the surface and said cleaning means such that the surface moves against said cleaning means producing a frictional force while removing the particles from the surface without damaging the surface;

said cleaning means includes a frame, and a blade, having one free end defining an edge, pressing against a surface with the other end being supported by said frame, wherein said blade has a flex modulus ranging from $2\times10^5$ to $5\times10^5$ psi, and the compounded lubricant additive of said blade reduces the dynamic friction between the surface and the edge of said blade by providing lubricating domains between the surface and the edge of said blade.

2. An apparatus as recited in claim 1, wherein said blade has a frictional coefficient of less than 0.1.

3. An apparatus as recited in claim 2, wherein the blade of said cleaning means is constructed from a polymeric thermoplastic chosen from a group of materials consisting of polycarbonate, polyacetal, polyamide, and UHMW polyethylene.

4. An apparatus as recited in claim 3, wherein the compounded lubricant additive of said blade is chosen from a group consisting of molybdenum disulfide, PTFE, PTFE oligomers, Kynar, Silicone, graphite, and Boron Nitride.

5. An apparatus as recited in claim 4, wherein said blade removes particles at least 2 microns in diameter from the surface.

6. An electrophotographic printing machine of the type having a movable surface with particles thereon, wherein the improvement claims:

means for cleaning the surface, said cleaning means constructed of a material with a compounded lubricant additive;

means for providing relative motion between the surface and said cleaning means such that the surface moves against said cleaning means producing a frictional force while removing the particles from the surface without damaging the surface;

said cleaning means includes a frame and a blade, having one end defining an edge pressing against the surface with the other end being supported on said frame wherein said blade has a flex modulus ranging from $2\times10^5$ to $5\times10^5$ psi; and the compounded lubricant additive of said blade reduces the dynamic friction between the surface and said edge of said blade, by providing lubricating domains between the surface and the edge of said blade.

7. A printing machine as recited in claim 6, wherein said blade has a frictional coefficent of less than 0.1.

8. A printing machine as recited in claim 6, wherein the compounded lubricant additive of said blade is chosen from a group consisting of molybdenum disulfide, PTFE, PTFE oligomers, Kynar, Silicone, graphite, and Boron Nitride,.

9. A printing machine as recited in claim 8, wherein said blade removes particles at least 2 microns in diameter from the surface.

10. A printing machine as recited in claim 6, wherein the blade of said cleaning means is constructed from a polymeric thermoplastic chosen from a group of materials consisting of polycarbonate, polyacetal, polyamide and UHMW polyethylene.

11. A cleaning device, comprising:

a rigid member;

a compounded lubricant additive internally combined with said rigid member; and said rigid member having a flex modulus ranging from $2\times10^5$ to $5\times10^5$ psi.

12. A cleaning device as recited in claim 11, wherein said rigid member is constructed from a polymeric thermoplastic chosen from a group of materials consisting of polycarbonate, polyacetal, polyamide, and UHMW polyethylene.

13. A cleaning device as recited in claim 12, wherein said compounded lubricant additive of said blade is chosen from a group consisting of molybdenum disulfide, PTFE, PTFE oligomers, Kynar, Silicone, graphite, and Boron Nitride.

* * * * *